US008075363B2

(12) United States Patent
Gomzar

(10) Patent No.: US 8,075,363 B2
(45) Date of Patent: Dec. 13, 2011

(54) DEVICE AND COMPOSITION FOR BLOWING A SOAP BUBBLE

(76) Inventor: Igor Mikhailovich Gomzar, St. Petersburg (RU)

( * ) Notice: Subject to any disclaimer, the term of this patent is extended or adjusted under 35 U.S.C. 154(b) by 1602 days.

(21) Appl. No.: 10/559,156

(22) PCT Filed: Nov. 17, 2003

(86) PCT No.: PCT/RU03/00516

§ 371 (c)(1),
(2), (4) Date: Dec. 1, 2005

(87) PCT Pub. No.: WO2004/112932

PCT Pub. Date: Dec. 29, 2004

(65) Prior Publication Data

US 2006/0154555 A1 Jul. 13, 2006

(30) Foreign Application Priority Data

Jun. 24, 2003 (RU) ..... 2003119064

(51) Int. Cl.
*A63H 33/28* (2006.01)

(52) U.S. Cl. ..... 446/19; 446/15; 446/20

(58) Field of Classification Search ..... 446/15–21
See application file for complete search history.

(56) References Cited

U.S. PATENT DOCUMENTS

| | | | | | |
|---|---|---|---|---|---|
| 430,095 | A | * | 6/1890 | Thain | 446/19 |
| 650,324 | A | * | 5/1900 | Horton | 446/19 |
| 697,063 | A | * | 4/1902 | Alhart | 446/20 |
| 705,966 | A | * | 7/1902 | Rockwell | 446/20 |
| 1,381,458 | A | * | 6/1921 | Dorris | 446/20 |
| 2,205,028 | A | * | 6/1940 | Bloxom | 446/19 |
| 2,433,625 | A | | 10/1944 | Raspet | |
| 2,469,045 | A | * | 5/1949 | La Vietes | 516/14 |
| 2,561,974 | A | | 1/1950 | Corbitt | |
| 2,587,895 | A | * | 3/1952 | Quinn, Jr. et al. | 446/20 |
| 2,711,051 | A | * | 6/1955 | Pick | 446/19 |
| 3,060,626 | A | * | 10/1962 | Panico, Jr. | 446/20 |
| 3,183,621 | A | * | 5/1965 | Allen, Jr. | 446/19 |
| 3,402,502 | A | * | 9/1968 | Kaysen | 446/19 |
| 3,630,951 | A | | 12/1971 | Netherly | |
| 4,229,902 | A | * | 10/1980 | Smith | 446/19 |
| 4,284,534 | A | | 8/1981 | Ehrlich | |
| 4,511,497 | A | | 4/1985 | Ehrlich | |

(Continued)

FOREIGN PATENT DOCUMENTS

GB 2086407 5/1982

(Continued)

*Primary Examiner* — Gene Kim
*Assistant Examiner* — Scott Young
(74) *Attorney, Agent, or Firm* — I. Zborovsky

(57) ABSTRACT

A device for soap bubble blowing has a tube through which a bubble is blown and which is provided with protrusions and recesses, and a ledge of a special shape on its walls, wherein the tube can be fitted in a lid which is joined with a container intended to keep a film-generating composition, and a composition for soap bubble blowing includes surface active agents, high-molecular substances, water, and high-boiling polar water-soluble solids, said surface active agents being selected of the group consisting of anion-active and non-nonionic agents, said anion-active surface active agents having a content of 1-5 by weight, said non nonionic surface active agents having a content of 0.1-1 weight percent by weight, wherein a ratio of said non ionic and ion-active surface active agents is 1:3-1:30.

14 Claims, 4 Drawing Sheets

U.S. PATENT DOCUMENTS

| | | | | | |
|---|---|---|---|---|---|
| 4,770,649 | A | | 9/1988 | Cuccio | |
| 4,988,319 | A | * | 1/1991 | Sheng | 446/19 |
| 5,088,950 | A | * | 2/1992 | LaFata | 446/19 |
| 5,156,564 | A | * | 10/1992 | Hasegawa | 446/15 |
| 5,180,283 | A | * | 1/1993 | Vickery, III | 417/234 |
| 5,190,490 | A | * | 3/1993 | Wachtel | 446/15 |
| 6,008,172 | A | | 12/1999 | Broshi | |
| 6,056,983 | A | | 5/2000 | Broshi | |
| 7,086,920 | B2 | * | 8/2006 | Fusco | 446/15 |
| 2002/0019470 | A1 | | 2/2002 | Ammon | |

FOREIGN PATENT DOCUMENTS

| | | |
|---|---|---|
| RU | 2139119 | 10/1999 |
| RU | 2193437 | 5/2001 |

* cited by examiner

DEVICE AND COMPOSITION FOR BLOWING A SOAP BUBBLE

BACKGROUND OF THE INVENTION

The invention relates to devices intended for soap bubble blowing for entertainment and show purposes.

A soap bubble may be described as a volume of gas contained within a spherical thin liquid film. Bubble-making toys and devices are widely used, being popular with children. The common principle of these devices or toys is that an outlet, such as a ring capping a stick, or a tube's end mouth, is wetted with a soap bubble generation agent. When the outlet is so wetted with the agent, a film is generated due to surface tension across the outlet, which film bends under gas pressure from one side of the outlet and generates soap bubbles splitting from the said outlet and flying away in the air.

To make larger-size soap bubbles, devices in the form of a frame (a ring with a holder) of a large diameter, or a tube are used. The use of a tube offers a smaller size and the easiest application of the device. To enhance the efficiency of bubble blowing, a tube is used with holes for additional inflow of air used in the soap bubble making. Examples of devices intended to make larger-size bubbles and based on soap bubble blowing with a tube are described in U.S. Pat. Nos. 2,205,028, 2,561,974, 2,711,051, 3,183,621, and 4,770,649, and in Russian Patents Nos. 2139119 and 2193437.

Soap bubbles are produced from special compositions. A typical composition for making toy bubbles contains water and a Surface Active Agent (SAA) dissolved therein. SAA reduces the surface tension of water so that when a ring or a tube is dipped into such composition, a composition film is generated across the outlet, bends under a gas flow from one side, and generates soap bubbles. Apart from SAA, a soap bubble blowing agent generally contains high-molecular substances and other additives. The composition is developed with regard to design features of the device used to produce soap bubbles and with regard to the soap bubble size and its lifetime to destruction. Examples of compositions for soap bubble blowing are described in U.S. Pat. Nos. 2,433,625, 2,469,045, 3,630,951, 4,284,534, 4,511,497, 6,008,172, and 6,056,983, Application No. 20020019470, and in UK Patent No. 2086407.

Reviewed below are several analogous devices intended to produce large-size soap bubbles.

U.S. Pat. No. 2,205,028 describes a tapered cardboard tube, on one side of which a mouthpiece for air forcing is fixed, while on the other side, the tube is wetted with soap bubble blowing composition. The mouthpiece is fixed along the tube's axis and spaced from one of its ends, so that fully opened apertures are left between the mouthpiece and the tube. When air is forced through the mouthpiece, an additional volume of atmospheric air is sucked into the tube (via the fully opened apertures), which is supplied for generation of soap bubbles on the opposite end of the tube. For better wetting of the tube outlet with the composition, a ring with slits is arranged inside the tube. The inner and the outer surface of the tube may be smooth or porous.

Disadvantages of such tube are its fully open apertures and its even (smooth) surface. The fully open apertures and smooth surface of the tube result in the composition flowing down the tube when a soap bubble is blown, especially when the tube is pointed upwards or horizontally. The composition flows down the tube wall and through its open apertures, and finally contacts the blower's hands and face. In addition, when catching breath (between expirations), the soap bubble film contracts and partly pushes warm and moist air out to the blower's face, which feels unpleasant.

The closest analog of the claimed device may be considered the soap bubble blowing device using air inflow to generate a soap bubble, which is described in the patent RU2139119 of Mar. 25, 1997. The device comprises a tube, with a nipple of a smaller diameter and apertures for atmospheric air inflow installed in its top part, while soap bubbles are generated on the bottom end. For easier use of the device, the tube may be combined with a lid and a container for soap bubble blowing composition, may have an adjustment ring to adjust the quantity of air supplied to generate a soap bubble, and may also be supplemented with a device for automatic soap bubble blowing. When the device is in use, a jet of air or gas is supplied via a nipple inside the tube. Using the underpressure created in the top part of the tube, an additional volume of atmospheric air is forced into the device to generate a soap bubble. Due to this effect, the device enables blowing of larger-size soap bubbles, or a multitude of medium-size bubbles.

A disadvantage of the above device is that the tube surface is made even (smooth), which reduces the efficiency of blowing large-size soap bubbles upwards.

Information on soap bubble blowing compositions refers to a previously known soap bubble blowing composition that is not toxic and does not irritate human eyes, and uses water solutions of SAAs and high-molecular substances, see UK Patent GB 2 086 407. This composition is a water solution of lauryl diethanol amide combined with the alcanol amide of sulfo-succinic acid ester, which is used as SAA, and contains also water-soluble, film-generating high-molecular compounds selected from the polyvinyl pyrrolidone-polyethylene oxide-polyvinyl alcohol group, and from derivatives of cellulose and gelatin. Apart from the above-listed components, the composition contains up to 10% of glycerin by weight.

This composition does not enable blowing large soap bubbles as it generates a thin soap bubble film, which is needed to produce a small bubble, but bursts at an attempt to produce a large soap bubble. Such composition is intended to obtain a higher number of small-size soap bubbles, i.e. its feature is blowing a multitude of small bubbles, rather than larger ones.

U.S. Application No. 20020019470 is known, which offers a feature of soap bubble generation from a solution of micelle-generating SAA combined with high-molecular substances and salts. The main feature of the composition is its side effect, i.e. generation of composition droplets and film particles after the bubble burst. The composition contains a high fraction of SAA and high-molecular substances, generally over 20% by weight, and is very viscous. Bubble blowing through a tube generates a film that is white or colored with specially added colorants.

This composition has a disadvantage of inability to blow large-size bubbles due to insufficient strength of film. Another disadvantage is that large amounts of droplets and film particles are produced when the bubble bursts. Such film particles and droplets may cause throat irritation if the bubble is blown and burst in close vicinity of the face.

The film-generating composition for making larger-size (approximately, 40 cm in diameter) soap bubbles may be considered as the closest analog of the claimed composition described in U.S. Pat. No. 3,630,951, where fluoroaliphatic compounds are used as SAA.

Compositions based on fluoroaliphatic SAAs as per U.S. Pat. No. 3,630,951 efficiently reduce the surface tension and enable making soap bubbles with a thick elastic film. Fluoroaliphatic SAAs are used as a solution containing 0.5-5% by weight of fluoric SAA. Several polymeric compounds are used as additives to this composition, such as polyethylene oxide, polyvinyl alcohol, polyglycols, etc. The solvent of the composition is water, with addition of 15-40% by weight of glycerin.

Among the disadvantages of the composition is its high viscosity, which dictates slow and careful blowing of a bubble, as the film is not stable enough in the initial period of blowing, and often bursts. This is especially manifest when soap bubbles are produced with the aid of the soap bubble blowing device as described in this application, which uses the principle of forcing an additional volume of air for soap bubble generation. With a glycerin content exceeding 40%, the composition looses its film-generating properties and separates, thus making bubble blowing impossible. The composition makes bubbles with a very thick film, and such bubbles are heavy. Besides, the soap bubble film obtained with this composition is not sufficiently colorful, and the bubbles when bursting produce solution drops that irritate eyes and cause a throat tickle.

SUMMARY OF THE INVENTION

The purpose of this invention is to provide a compact and easy-to-use soap bubble blowing device intended to obtain large-size soap bubbles, the flight of which can be efficiently controlled by blowing such soap bubbles upwards (above the blower's head). Another purpose of the invention is to provide a device enabling to adjust the size and number of soap bubbles to be produced, and to control the flow rate and humidity of air forming soap bubbles.

The claimed purpose is achieved by providing a device using the kinetic energy of a gas jet for additional forcing of air for generation of a soap bubble, where the tube walls have protrusions, recesses (folds), and a ledge of a special shape, to ensure the best conditions for soap bubble film generation. Such a tube may be made of a deformable material allowing for adjustment of the dimensions, shape, and flow area of the apertures, have slot-like apertures between the protrusions and recesses on the surface of the tube, additional slits, and a leaf valve on the tube's apertures, and may be inserted in a casing having a heater for the air supplied for generation of a soap bubble. Foe easier use of the device, the tube may be fixed in the lid, which is attached to the container intended to keep the composition for soap bubble blowing.

The invention also aims to provide a composition for blowing large-size soap bubbles with a durable and colorful film, which is harmful and does not irritate skin, eyes, and respiratory tracts.

This aim of the invention is achieved by using anion-active and nonionic SAAs, and other composition components in optimum proportions. SAA is selected out of the anion-active and nonionic group, the content of anion-active surface active agents being 1 to 5% by weight, and the content of nonionic surface active agents being 0.1 to 1% by weight, the ratio of nonionic and anion-active surface active agents being 1:3 to 1:30. Furthermore, anion-active SAAs are selected out of the group of alkyl sulfates, alkyl benzosulfonates, and oxyethylated alcanol sulfates, while nonionic SAAs are selected out of the group of oxyethylated alcanols and oxyethylated fluorine-containing alcanols. The composition may additionally contain components consisting of molecules with hydrophobic radicals at their ends and hydrophilic groups in the middle part, solubilized organic substances, organofluoric compounds, high-molecular compounds, and salts.

The purposes and advantages of the invention will become clearer from the following detailed description.

The soap bubble blowing device described in these claims enables to produce large-size soap bubbles floating upwards, which is related to the ability to produce lighter-than-air soap bubbles, and to the possibility to accelerate the bubbles due to the air flow energy, with the device held with its outlet upwards. The device also provides ampler ability to produce soap bubbles of a larger size (10-50 cm in diameter, and larger) by improving its performances through improved design components. The claimed soap bubble blowing device may have different embodiments. It comprises a tube with folds having apertures for additional air inflow, and may also comprise auxiliary elements such as a nipple for air supply, a lid and a container for sealing of the device, etc.

The most important element of the soap bubble blowing device is the tube, on which soap bubbles are generated and grown. The tube may have a cylindrical, tapered, or a more complex (fashioned) shape, in particular with flared and narrowed portions. The tube has apertures for air inlet. The tube has an end outlet and additional outlets that may be provided in the tube walls. To improve the conditions of soap bubble film generation, the tube has a wave-like surface formed by alternate protrusions and recesses (folds). A tube wall made with folds increases the real surface area of the tube and renders it several new consumer properties, improving soap bubble generation and extending the abilities of the device. Protrusions and recesses (folds) formed by surface irregularities or provided as corrugations take some or all of the surface of the tube.

For soap bubble blowing, the tube is wetted with a composition needed to generate a soap bubble film. The composition's retention in the tube folds and its flowing over the tube allow to accumulate much more composition on its surface than with a smooth-surface tube. The composition is accumulated on the tube surface (in the folds), and to a lesser extent, flows down the tube, unlike a tube without folds. As the number and size of the folds increase, the quantity of the composition retained on this surface increases accordingly. As soap bubbles are blown, the composition is partly entrained by the air flow, and travels via the folds towards the tube's end where the soap bubble is generated. This enables gradual supply of the composition for generation of a soap bubble as it is blown up, and the related demand for new portions of the composition. Gradual supply of the composition for generation of a soap bubble film is ensured by adjusting the tube's angle of inclination and the speed of the gas flow inside the tube, and by rotating the tube, which enables increasing the size of the soap bubble, as gradual supply of the composition to the bubble is provided jointly with air supply for its blowing.

The folds on the tube's surface are arranged as alternate protrusions and recesses, and may have different shapes. The protrusions on the tube's surface may be designed as smoothed fins, and the recesses, as cavities between the fins. depending on the tube thickness, the folds may be rigid or deformable, and may be shaped as alternate grooves or corrugations. Protrusions and recesses may be provided either only on the tube's outer surface (the inner surface remaining smooth), or only on the inner surface of the tube (the outer surface remaining smooth), or on the outer and inner surface of the tube simultaneously. The number of protrusions and recesses on the outer and inner surface of the tube, and their size may be different. The tube surface may have at least three protrusions and three recesses forming folds, where the number of folds in the top and bottom part of the tube wall may differ. The number of folds on the tube surface is related to the tube diameter, size of soap bubbles to be obtained, properties of the bubble blowing composition, and design features of the device. Generally, folds are designed as extended longitudinal grooves over the entire length of the tube or part thereof. The tube may also be provided as partially folded, for example on one end only, or folds may be provided on both ends of the tube, without folds in its middle part. The shape of the folds may be different: rounded, square, triangular, or of a more complex configuration. The folds may be additionally provided with slits, channels, and capillaries to increase the surface area and to improve the composition retention, in particular by capillary forces. The folds may be designed not only longitudinal but also skewed, spiral, or transverse, or in various combinations thereof. In this case, due to adjustable spread of the composition over the surface of the folded tube, it can be gradually moved along the tube at its inclination or rotation about its axis, which enables producing soap bubbles of a larger size or in a larger number than on a tube with an even surface. The apertures for atmospheric air inflow made in the tube walls may have a form of slits or slots arranged in the tube folds.

For more convenient use of the soap bubble blowing device, it should preferably be held horizontally, or at a certain angle up from the horizontal line (the most convenient position) during the bubble blowing. This allows for fast-response adjustment of the tube's inclination angle during the blowing, and for control of the flight of a soap bubble. In this case, soap bubbles generated on the end of the tube fly mostly upwards, that is, after tearing off the tube, the bubble flies up above the head, and then gradually lowers, making a much longer way in the air than with the device's tube turned downwards. The ability to blow a soap bubble upwards greatly depends on the tube wetting conditions, and on the conditions of film generation on the bottom end of the tube. As was mentioned above, protrusions and recesses arranged on the tube's surface improve supply of the composition to the soap bubble. In addition, the design of the bottom part of the tube has a significant influence on soap bubble blowing.

When a soap bubble is blown, the composition wetting the tube end surface is driven to generate a soap bubble film. During the blowing, the film initially generated on the tube's inner surface in its narrowest portion moves to the outer surface of the tube, to the part of the tube having the largest diameter. The soap bubble will then be attached to the maximum diameter point of the tube, and may travel along the tube moved by air fluctuations, but always returning to the maximum point of expansion. Therefore, the bottom part of the tube is designed with a bulge, providing a ledge on it. The soap bubble film moved to the ledge is stronger and thicker, which enables blowing bubbles upwards, accelerating them when tearing off the tube, and producing larger-size bubbles when the ambient air has a low humidity. The ledge provided with its end edge (or part thereof) at an angle facilitates smooth (without jerks) travel of the soap bubble along the tube, and removal of the composition therefrom for generation of a soap bubble. The air leaving the tube's outlet passes to the soap bubble at a distance from the edge of the soap bubble film, which moves to the point of the maximum diameter of the ledge, and therefore is less sensitive to the effect of convective currents. The lifetime of the bubble film increases, as it dries slower due to lower contact with dry air entering the bubble. The bubble stabilization at the point of the tube's maximum diameter improves the film generation conditions. In this case, blowing of large-size soap bubbles is much more efficient than with a tube without a ledge.

The ledge is designed as an integral part of the tube or as a separate ring to be put on the tube's outer side, or to be inserted in the tube's end. The ledge forms a flare of the outer part of the tube, and may form a restriction of the inner part of the tube. The ledge is generally arranged at the tube's end, but it may also be spaced from the tube's end, or be movable.

Where the ledge is provided as an integral part of the tube, it is designed as a bulge of the bottom part of the tube wall. On its end (bottom) side, the ledge has a tapered portion, and on its rear (top) side, a tapered portion generally matching indents or grooves in the ledge to accumulate the composition. Where protrusions and recesses, folds, or fins are provided on the outer surface of the tube, the latter may abut the ledge. Furthermore, the indents in the rear part of the ledge may be designed to match the recesses on the tube's surface, which increases accumulation of the composition needed to generate a soap bubble on the ledge. Indents in the rear part of the ledge are provided also to reduce the weight (volume) of the ledge when this component is manufactured from plastics by die casting.

Where the ledge is provided as a separate ring, it is fixed on the tube without a clearance (tight) or with a clearance (loose) left between the tube and the ring. The ring is fixed on the outer surface of the tube, or may be fixed on the tube's protrusions or on fins made in the tube or in the ring. Furthermore, indents in the tube may form through channels and openings between the tube and the ring, or blind channels facing the ring. Where the ring is attached with a clearance, the preferable clearance width is 0.1 to 10 mm.

The ledge thickness is as thick as the widest part of the tube wall bulge, i.e. within 2-10 mm; however, it may also be different, subject to the tube diameter and the composition used. For more efficient stabilization of soap bubbles at the maximum diameter of the tube, the bulge is designed as a ledge of a moderate width, generally 2-10 mm. The ledge is generally beveled, with the bevel (inclination) angle within 90-15°, but the preferable bevel angle is about 45°. From the end and the rear of the tube, the ledge is generally gradually reduced to the tube diameter, preferably at 45°, although the angle may be within 90-15°. Furthermore, the bevel angles of the bottom (end) portion of the ledge and its top part (rear) may differ. The ledge itself may consists of portions at different angles, for example, of an end portion at the angle of 90° and a tapered portion at 45°, with a bevel of 45° in its rear part.

The optimum dimensions and angles of the ledge are named subject to the use of the soap bubble blowing composition as described in the second part of this application.

For better wetting of the ledge with the soap bubble film generating composition, additional slots, grooves, flutes etc. may be provided on its surface. The ledge may have different geometric shapes, with a concave or convex tapered part. It may also have a wave-like surface, or may be rounded, or otherwise shaped. Apart from its main purpose, the ledge serves as a blade to remove foam generated during soap bubble blowing from the composition container.

A ledge provided on the tube enables blowing soap bubbles upwards due to the kinetic energy of the air flow, while the lower density of the warmer air inside the soap bubble enables launching bubbles above the blower's head and controlling their flight, which is especially effective when the ledge is combined with protrusions and recesses on the tube's surface. Thus, a tube combining a ledge with folds on its outer surface improves soap bubble film generation and enables blowing much larger soap bubbles than with an ordinary tube, especially when the bubbles are to be launched upwards. The use of a tube with a ledge in its bottom part in the device also notably increases the lifetime of a soap bubble, which is due to a thicker film generated and its better supply with the composition, thus increasing the size of a bubble during its blowing.

The design of a tube that is folded (has folds) enables adjustment of its functional dimensions by compacting or straightening its folds. To achieve this, the tube is made of a material that is deformable under a slight force exerted when the tube is squeezed with a hand or with a simplest appliance. As applied to the specific aspects of blowing of soap bubbles of different size, deformability of the folded tube offers several advantages over a tube without folds. A tube having longitudinal folds in the form of corrugations allows for adjustment of its overall diameter, or of the diameter of its particular parts, which is a very significant factor in the generation of a soap bubble. When a tube with longitudinal folds is radially squeezed, the folds are deformed and compacted, with the tube diameter decreasing. For a tube deformable plastically, straightening or folding of the corrugations allows for direct adjustment of its dimensions. For a tube of a resilient material, a new position of the tube may be fixed to obtain a smaller-diameter tube. For example, a resilient corrugated tube may be squeezed with a hand, the compressed tube may be inserted into a smaller-diameter ring or clasped in a yoke and thus obtain a tube of a smaller diameter. When the ring or yoke is taken off the tube, it will regain its initial diameter. Similarly, the tube diameter may be increased relative to its initial size by pre-expanding the tube. For a resilient tube, a larger-diameter ring may be installed inside it, fixing the new larger diameter of the tube, as the ring will be thrusting the tube out, and the folds will straighten thus increasing the diameter. Similarly, a tube of another shape, such as oval, may be obtained. That is, a folded (corrugated) tube allows for adjustment of its diameter by contraction and straightening of the folds, such adjustment being also possible in the process of bubble blowing, by squeezing or releasing the resilient tube with a hand. Due to this property of a corrugated tube, soap bubbles of different size may be produced with the same tube, as the size of soap bubbles blown materially depends on the diameter of the tube on which they are generated. The smaller-diameter tube will produce bubbles of a medium and small size, and the large-diameter tube, bubbles of a large size.

Adjustability of the tube's dimensions subject to folding of its corrugations also allows for adjustability of its shape. By deforming a resilient tube of a plastic material at any point, its dimensions may be adjusted thus modifying its shape. For a resilient tube with longitudinal folds, the shape may be modified by transforming the tube in one of its parts, for example by fitting expanding rings inside the tube and by fitting restricting rings at its ends or in its middle part. In this case, tapered flares or contractions of the tube may be achieved. For example, a tube of a shape classical for jet compressors may be obtained, i.e. having a restriction in the middle part and flaring at the ends. A tube tapering downwards may be obtained, with which tube soap bubble blowing would be steadier. Where a tube with transverse corrugation is used, the tube may be elongated or shortened by squeezing or releasing it along its axis, or its curvature may be modified by straightening or compressing the folds on one of the sides of the tube. That is, a tube having folds and made of an easily deformable material may change its diameter and shape during contraction. Resilience rendered by longitudinal corrugations allows to squeeze and release the tube changing its cross-section, while transverse folds enable stretching and bending of the tube. Both actions may be performed with combined or spiral corrugation. A folded or wave-like tube allows to unify blowing of large-size and small-size bubbles, and improves the functional abilities of the claimed soap bubble blowing device due to adjustability of the flow area, length, and shape of the tube.

As to additional abilities of the soap bubble blowing device, it should be noted that a folded design of the tube's surface also allows for more efficient damping of the air supplied for generation of a soap bubble when the inner and outer surface of the tube is wetted with water. Damping of the air inside the soap bubble enables to improve the bubble film stability by retardation of the film drying during its contact with dry air. A folded tube has a larger surface area compared to an ordinary tube, and its wetting with water significantly increases the contact surface, therefore air is efficiently damped when passing through the tube. To increase the water-wetted surface of the tube, the maximum number of folds is provided; furthermore, apart from the folds in the tube walls, additional folds may be provided to increase the tube's surface area. The slits increase the quantity of moisture on the tube as a result of higher capillarity and larger overall surface area. Additional slits on the tube's surface may have the form of notches, grooves, pores, and indents. The tube may be wetted with water, for example, by pouring it inside the device, or the film-generating composition itself and its foam are used for the tube wetting. Water is retained in the tube's folds and slits, and during the bubble blowing it evaporates and damps the air due to the contact with air passing inside and outside the tube. For more efficient damping of air, an insert made of porous materials or water-soaked fabric etc. may be placed in the tube. For this purpose, elastic porous materials may be used, to be put on the tube thus covering all or some of the air inflow apertures, while the air passing through the porous material is damped and further supplied for generation of a soap bubble. Thus, when air is damped using a folded tube, it becomes possible to increase the number and size of bubbles, especially when the air humidity is low, by increasing the lifetime of the film.

To adjust the flow rate of air supplied to generate a soap bubble, and to prevent air displacement from the tube by the air bubble film between expirations, leaf valves may be fitted in the tube's apertures. Such a valve is designed as a thin shield (tape) pressed to the inner surface of the tube in the form of leaves of a polymeric material. When not in operation, the leaf valve closes the apertures in the tube walls. When air is forced via the nipple into the tube, an underpressure is created in its top part, the leaves bend off, and the apertures open, thus providing air inflow. Between the expirations, the leaves lock the apertures, thus preventing back escape of air. The leaves are pressed against the tube walls with a minimum force, and easily split off the apertures when a bubble is blown due to the differential pressure inside and outside the tube. A leaf valve so arranged enables adjusting the flow rate of air sucked in, and closing the device when no expiration is performed, the valve being closed by the leaves pressed against the tube wall by adhesion, and also by pressure generated by the soap bubble film tending to reduce the surface. To facilitate the leaves' coming off the tube surface, its inner part may have flat portions, to which the leaves are pressed. The leaves are fixed directly on the tube, by attaching them to the tube surface with one side, and leaving the other side free. The leaves may be fixed on a ring to be inserted into the tube, to one side of which ring the leaves may be attached. In this case, the ring is fixed in the tube, for instance, due to elastic deformation of the folds. To facilitate the leaves' pulling off the tube apertures, they may have small pins protruding outwards through the tube apertures. By pressing the pins with fingers, the flow of air through the apertures may be adjusted. Installation of a leaf valve facilitates blowing of large-size soap bubbles by younger children, and enables long pauses between expirations without diminishing the bubble size.

To modify the temperature of air supplied to generate a soap bubble, an additional element is used, which is a heater or a heat exchanger. The heater is arranged in a special casing. In its simplest version, the casing is made of two parts abutting each other, and is provided with one or more handles for easier use. There is a free cavity inside the casing, where the heater is fixed, such heater being a hot-water bag or bottle, a burning candle, a Bengal light, etc. An opening is provided in the casing wall, in which the soap bubble blowing device is inserted and fixed. The device is inserted into the casing's opening and thus fixed therein, the air inflow apertures in the tube walls being inside the casing, and the tube ends left outside it. When the device is in use, the casing may be held by the handle while forcing air into a soap bubble. The sucked-in air passes inside the casing, is heated from a heater or heat exchanger, and is supplied for generation of a soap bubble through the apertures in the tube walls. The use of a heater enables to increase the air temperature inside the soap bubble, and obtain lighter bubbles splitting from the device and dashing upwards. Furthermore, the casing may be designed in a visually attractive form, such as a nice figure etc.

To make the device more efficient when blowing bubbles of larger sizes, and for easier use thereof, the folded tube is matched with a nipple of a smaller diameter (of a smaller perimeter). Generally, the nipple is aligned with the axis of the tube, and is fixed thereon. The nipple may be fixed at an angle to the tube's axis, or rotatable to an angle of up to 90 degrees related to the axis. In the latter case, it is attached with flexible (elastic) connecting strips, which allows for control of the gas flow inside the folded tube at variations of the inclination angle, and for orientation of the tube and the nipple irrespective of each other. For the same purpose, the nipple may be connected to the tube via an elastic insert (such as a rubber portion of the nipple). Air is forced through the nipple by exhaling it or supplying it with small-size manual or stand-alone compressors (air blowers).

The easiest in use is a soap bubble blowing device combined with a lid and a container for the composition used to generate the soap bubble film (a combined-type device). In such a device, the lid protects the hands and face against drops of the composition spreading over the tube when blowing soap bubbles. The tube of the device has folds and a ledge and is fixed in the lid. When a bubble is blown, air is supplied to the tube via a clearance between the tube and the lid. That is, due to the clearance between the lid wall and the tube, inflow of additional atmospheric air to the tube is provided for generation of a soap bubble. Furthermore, the passing of air between the lid wall and the tube prevents to a great extent any back flow of air from the soap bubble to the tube during breath-catching between expirations. This is explained by higher resistance to the flow of air from the tube to the clearance.

The tube may be fixed in the lid rotatably, which helps to obtain a more uniform film when blowing a soap bubble due to more uniform supply of the composition. For instance, the tube may be fixed (snap locked) with its top part on the nipple built into the lid, while resting with its middle part on fins provided in the lid to ensure a clearance between the lid wall and the tube. A tube so fixed may be rotated with a hand.

In a combined-type device, air is more efficiently heated by the warmth of the hand holding the device. With fins provided in the lid, the heat transfer still increases, the heat from the hand being transferred to the lid and heating the air passing in the clearance between the lid and the tube more efficiently. This helps to produce lighter soap bubbles without additional air heating arrangements. This effect increases with the number of the fins in the lid and with higher thermal conductivity of the lid's material.

The combination of the lid and the container is useful for protection of the composition against evaporation when the device is not operated, and for appearance design purposes. The lid makes the device more attractive visually, enables diversifying its shape, and allows for sealing of the device.

Sealing of the lid and the container in the device is accomplished after they are coaxially aligned and the tube's bottom end is lowered into the container, by screwing the lid onto the container, or by any other known means. To seal the nipple, a plug is used, which is attached to the lid with a flexible lead (generally a tape of a polymeric material). The flexible lead is fixed to the lid with one end, the other end having a plug to seal the nipple. For example, the plug may be attached to the lid with a flexible lead having a ring at its end, which ring is fixed to the nipple. Apart from the plug, the lead may have a tip (or several tips) attached thereto to elongate the nipple, and a ring, which is put on the nipple to fix or secure the lead. The flexible lead may be used for easier holding of the soap bubble blowing device on a hand, by putting the hand between the lead and the lid, which ensures a more reliable grip of the device.

In a combined-type device with adjustable flow areas, the air flow rate and the air composition inside the soap bubble are changed with the tube fit depth in the lid (by varying the tube extension depth). By changing the tube fit depth in the lid, the diameter of the tube fitted in the lid will be changed due to its deformation (squeezing or straightening the tube's folds). This will modify the flow areas in the top part of the tube, and the flow rate and composition of air supplied for generation of a soap bubble will be modified accordingly. This feature may be used to set up the device for different weather conditions, air temperature, and air humidity, and for different users, subject to their desire to get larger or smaller bubbles. In this way, quantitative adjustment of air inflow in the device is provided without any additional adjusting arrangements.

DESCRIPTION OF THE PREFERRED EMBODIMENTS

Figure 1:
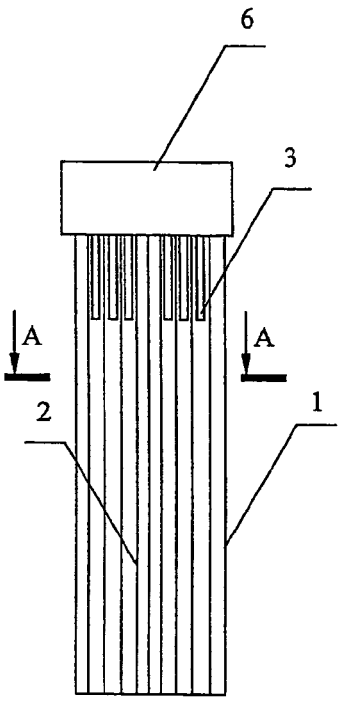
FIG. 1 is a schematic view of the soap bubble blowing device embodied as a folded tube.

FIG. 1 presents a schematic view of the soap bubble blowing device. The device is embodied as a folded tube (1), with longitudinal folds (2), slot-like apertures (3) in its walls, and ring (6) upon its end.

Figure 2:
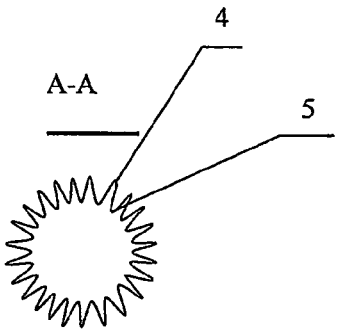
FIG. 2 shows the tube cross-section along the A-A line.

FIG. 2 shows protrusions (4) and recesses (5) of the tube surface.

For additional inflow of air supplied to generate a soap bubble, slot-like apertures (3) are provided in the walls of folded tube (1) having longitudinal folds (2). Apertures (3) in the tube are shaped as slits (slots) arranged in the folds (protrusions (4) or recesses (5)) of tube (1). Such arrangement and configuration of apertures (3) allows for an additional adjustment effect related to airflow variation with deformation of tube (1). When tube (1) with longitudinal folds (2) is radially compressed, folds (2) are displaced overlapping the flow area of apertures (3), and vice versa, when tube (1) is radially extended, folds (2) straighten, and the flow area of apertures (3) increases. In this case, the quantity of air sucked into the device varies with the variations of the flow area of apertures (3). By compressing and releasing tube (1), or by fixing its size with a ring or yoke of a smaller diameter slid onto the tube, air inflow supplied to generate a soap bubble may be adjusted. For easier use of the device, the outlet end of the tube through which air is forced may be protected with ring (6), having a rounded (smoothed) shape, with folds (2) of tube (1) attachable to ring (6) having an inner coaxial groove. The ring covers the tube folds at its end and protects the end against spreading of the film-generating composition, and also allows to press the tube's outlet against the lips.

Figure 3:
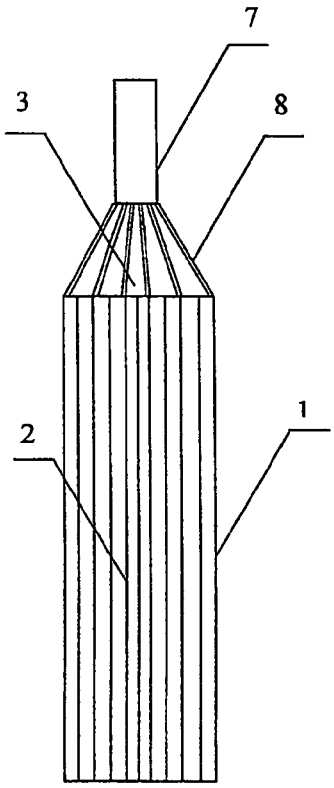
FIG. 3 shows the soap bubble blowing device with a nipple for air forcing.

In FIG. 3, the soap bubble blowing device has nipple (7), fixed on folded tube (1) with connecting strips (8).

Nipple (7) serves to supply gas or air into folded tube (1); it is fixed on the tube with connecting strips or fins (8) arranged in the tube between apertures (3). Nipple (7) is fixed on folded tube (1) so as not to prevent compression or expansion of the tube in case of its deformation; it may be integral with folded tube (1), or be fixed thereon.

In a soap bubble blowing device combined with a lid and a film-generating composition container, the nipple is fixed in the lid.

Figure 4:
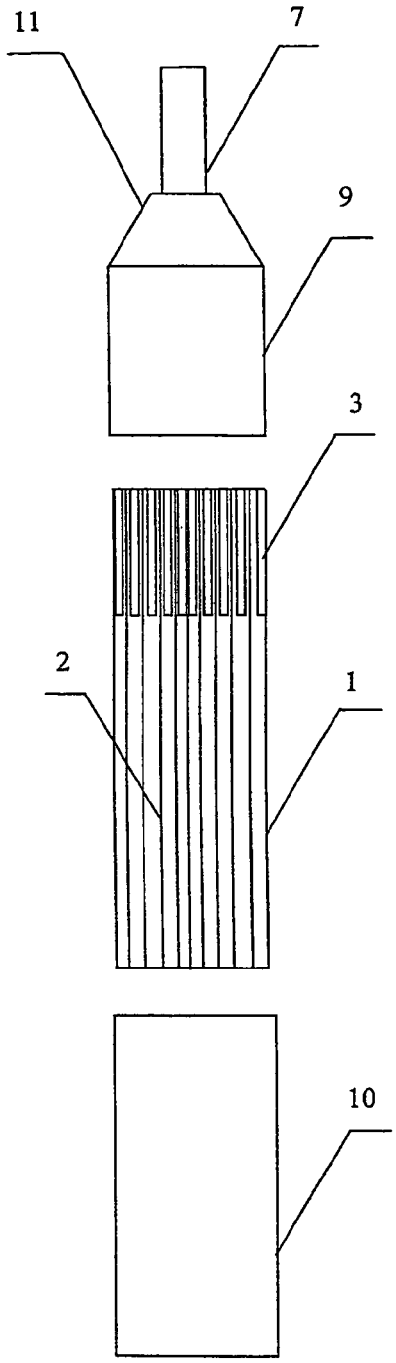
FIG. 4 shows the soap bubble blowing device combined with a lid and a film-generating composition container.

In FIG. 4, the soap bubble blowing device is combined with lid (9) and film-generating composition container (10), the lid having taper (11) in its upper part.

Such soap bubble blowing device comprises a folded tube (1) inserted in a body consisting of lid (9) and container (10). Folded tube (1), of a cylindrical or tapered shape, is fixed in the lid with the aid of deformation of folds (2). Where the diameter of lid (9) is made slightly less than the diameter of folded tube (1), resilient folded tube (1) is placed in lid (9) after radial compression of tube (1), folds (2) being compressed and tube (1) being inserted into lid (9). When tube (1) is released, it straightens and gets fixed in lid (9). In this case, its protrusions (4) forming the fins abut the lid's walls, while recesses (5) form apertures (a gap) between the wall of lid (9) and tube (1). By moving tube (1) relative to lid (9), its fit depth and the flow area of the end outlet may be adjusted.

The ability to adjust the air flow in the device combined with lid (9) and container (10) by deformation of folded tube (1) is used when lid (9) has tapering (11) in its top part, while the top part of folded tube (1) has slot-like apertures (3). When tube (1) is inserted in lid (9) and is pushed inside, the top part of tube (1) abuts tapering (11) of lid (9) and is deformed, connecting strips (8) of tube (1) are displaced overlapping the flow area of slot-like apertures (3). When the device is in operation, air gets into the clearance between the inner surface of lid (9) and the tube, and passes in the grooves of recesses (5) of tube (1), and next, via slots and apertures (3) of tube (1), it gets into its inner part and is entrained to generate a soap bubble.

Figure 5:
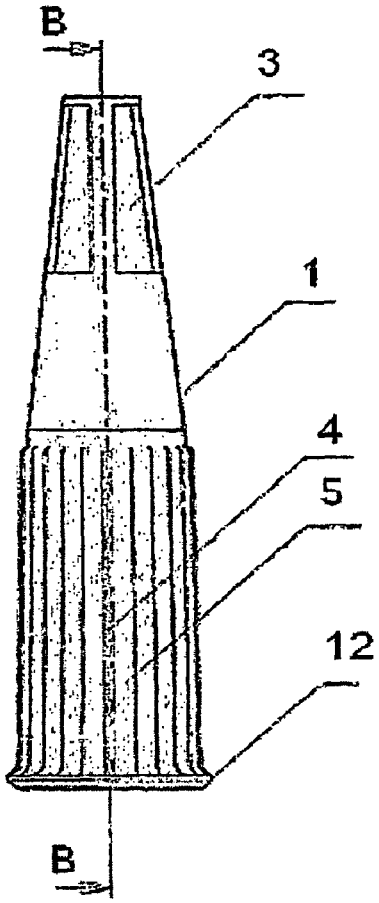
FIG. 5 shows the device comprising a tube with apertures in its upper part having protrusions, recesses, and a bulge (ledge) on its outer surface.

In FIG. 5, the device comprises tube (1) with apertures (3) in its top part, and with protrusions (4), recesses (5) and bulge/ledge (12) on its outer surface, the ledge improving film generation at the tube end.

Figure 6:
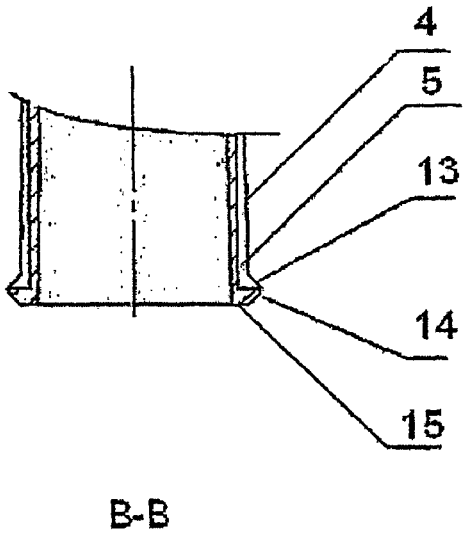
FIG. 6 shows the cross-section of the tube as per FIG. 5.

FIG. 6 shows the cross-section of the bottom part of tube (1) as per FIG. 5. Protrusions (4) arranged on the outer surface of tube (1) at angle (13) develop into ledge (12). The ledge has a tapered part (14) and an end section (15) arranged at a square angle. Recesses (5) on the outer surface of the tube in the rear part of the ledge also form indents (recesses in the ledge) improving its wetting with film-generating composition. Such tube may be used for stand-alone soap bubble blowing, it may be supplemented with a nipple fixed in the top part for easier blowing, and may also be intended for fixed in a lid in a device combined with a container for film-generating composition.

Figure 7:
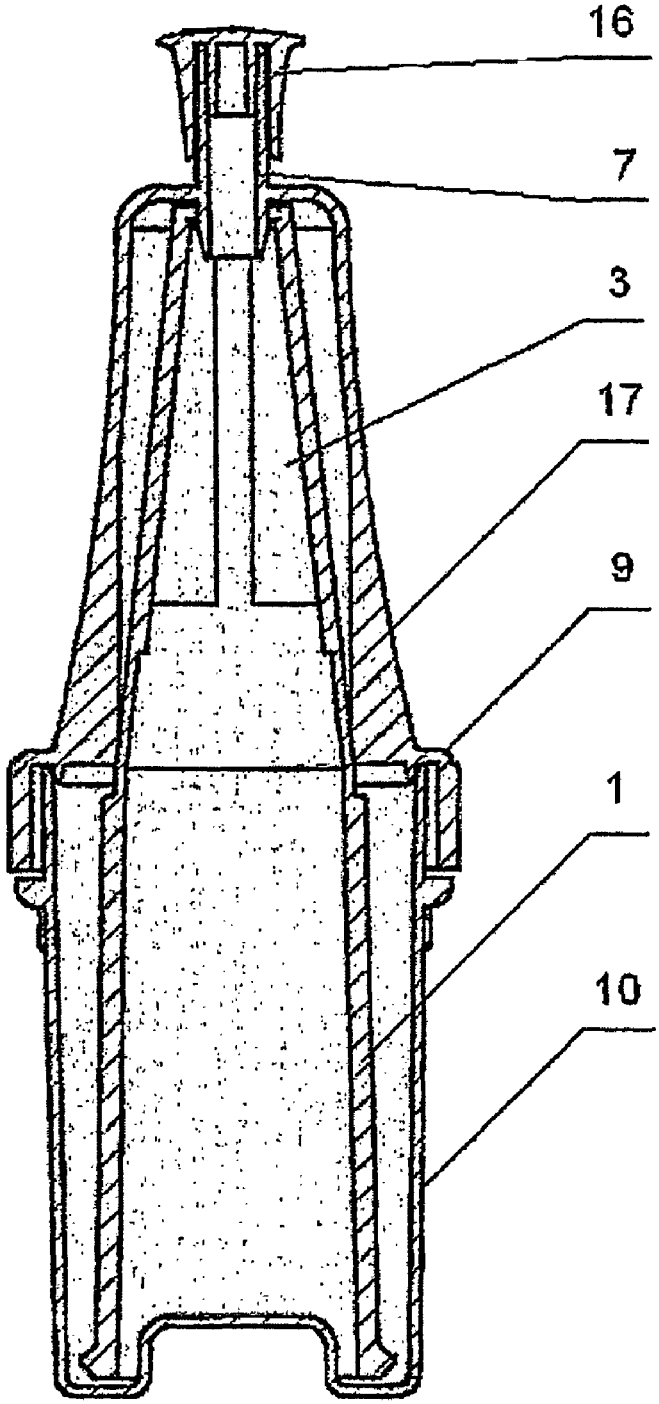
FIG. 7 shows the soap bubble blowing device with a tube having folds and a ledge and combined with a film-generating composition container.

In FIG. 7, the soap bubble blowing device comprising a tube as per FIG. 5 is combined with container (10) for film-generating composition. In this embodiment of the device, tube (1) is fixed on nipple (7) built in lid (9) and closed with plug (16). With its middle part, tube (1) abuts fins (17) made in lid (9) to provide a clearance between the wall of lid (9) and tube (1). This ensures inflow of air to be supplied for generation of a soap bubble via the clearance between the walls of tube (1) and lid (9), and apertures (3) provided in tube (1). Additional improvement of soap bubble film generation may be achieved with the device shown in FIG. 7, i.e. with loosely fixed tube (1). The end of tube (1) is fixed on nipple (7) not rigidly, but allowing for rotation (the tube is locked by an axial displacement, but remains freely rotatable). Hand rotation of the tube held by folds on its surface ensures the most uniform spread of the composition, with a film of similar thickness generated. This enables to produce soap bubbles of the maximum size.

Figure 8:
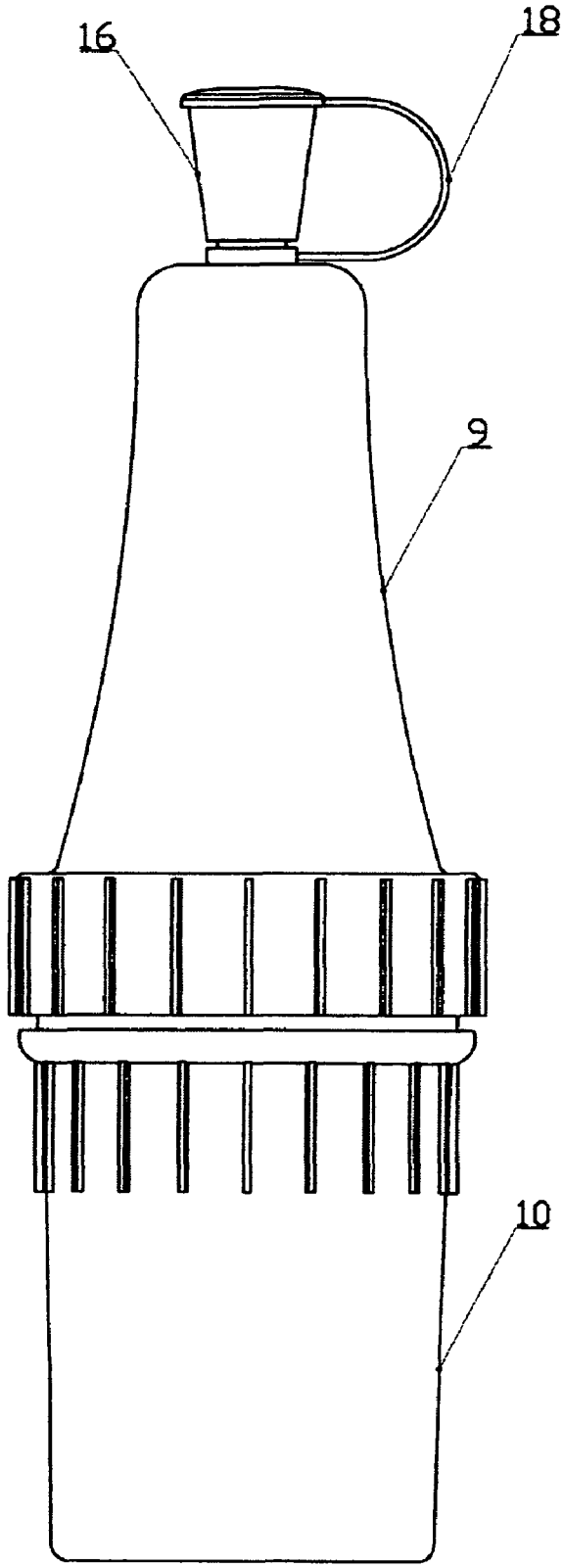
FIG. 8 shows the appearance of a combined-type soap bubble blowing device.

FIG. 8 shows the device as per FIG. 7 as assembled, where flexible lead (18) with a ring on its end fixes plug (16).

The above-described soap bubble blowing device uses a special mixture, or composition, for soap bubble blowing, the properties of which are optimized for the claimed device. The composition generates a strong, elastic, and colorful film of soap bubbles, and enables blowing either large-size bubbles or a multitude of smaller-size bubbles.

A description of the composition will disclose the second object of the invention.

The composition developed to produce large-size soap bubbles with the aid of the claimed soap bubble blowing device enables blowing large colorful soap bubbles that can fly upwards. A number of requirements are set for such composition related to the necessity to obtain the optimal thickness, colorful effect, and elasticity of the film of a large soap bubble. Achievement of all these properties is related to preparation of a multi-component composition, which is described below.

The soap bubble blowing composition is an aqueous solution of anion-active SAA combined with nonionic SAAs, soap bubble film stabilizing components, high-molecular substances, electrolytes, etc. The percentage content of anion-active SAA in the composition is preferably 0.5-5% by weight, while the content of nonionic SAAs is 0.1-1% by weight. The ratio of nonionic and anion-active SAAs is within 1:3 to 1:30. To reduce the surface tension and to improve the elasticity and durability of the film, the composition may additionally contain components stabilizing the soap bubble film, organic SAAs of other types such as halogen-containing SAAs, for instance fluorine aliphatic SAAs, and solubilized organic and fluorine-containing substances. Apart from water, other water-soluble polar solvents may be used in the composition, with their concentration reaching 90% by weight.

The claimed composition ensures a colorful, durable, and elastic film of a large soap bubble. The size of a bubble obtained with this composition when blown with a soap bubble blowing device having additional air inflow may reach one meter in diameter.

The anion-active SAAs used in the soap bubble blowing composition are alkyl sulfates with the common composition $ROSO_3M$, which may be both primary and secondary, alkyl sulfonates $RSO_3M$, alkyl benzene sulfonates, and anion-active derivatives of nonionic SAAs such as sulfates of oxyethylene alcanols $R(OCH_2CH_2)_nOSO_3M$, or other known compounds having surface active properties. In the above compositions, R usually contains 8 to 22 carbon atoms (hereafter, R means alkyl with a linear or cross-linked chain, if not otherwise specified), M stands for univalent metal, ammonium ion etc., and the number of oxyethylene groups (n) is 1 to 3. For more efficient reduction of surface tension, some or all of the hydrogen atoms in the hydrophobic part of anion-active SAAs may be substituted with atoms of a halogen, preferably by fluorine atoms. The content of anion-active SAA must not exceed 5% by weight, and should preferably be within 1-3% by weight.

To adjust consumer properties of the composition, it may contain SAAs of other types (ampholytic, cationic), fluoro-aliphatic in particular.

Nonionic SAAs used in the composition are substances that are poorly soluble by water and polar organic solvents. These are linear and cross-linked oxyethylated alcanols with the common composition $RO(CH_2CH_2O)_nH$, oxyethylated alkyl phenols $RArO(CH_2CH_2O)_nH$ with the number of oxyethylated groups n=1 to 5 and the number of carbon atoms in the hydrophobic chain R=8 to 20, and oxyethylated carboxylic acids and oxyethylated amines and esters. In the above composition, Ar stands for aromatic hydrocarbon radical with the number of carbon atoms of 6 to 10. By attaching different numbers of ethylene oxide molecules, one may modify the physical properties of nonionic SAAs in a broad range, but of primary importance for preparation of a large-size soap bubble blowing composition are SAAs with few oxyethylene groups and low solubility by water and polar solvents used in the composition.

Apart from the above-listed components, derivatives of alkyl carboxylic acid amides $RCONHOCH_2CH_2OH$ may be used, where R comprises 7 to 20 carbon atoms. The composition may also contain nonionic SAAs such as block copolymer resins containing oxyethylene and oxypropylene fragments. The use of nonionic SAAs, in which some or all of the hydrogen atoms in the hydrophobic chain are substituted with halogen (fluorine) atoms, improves consumer properties of the composition. The number of oxyethylene groups (n=1-5) needed to achieve a certain degree of solubility of nonionic SAAs is related to the number of carbon atoms in the hydrophobic part of an R molecule, and to the degree of fluorination of the hydrophobic radical. With the number of carbon atoms in the alkyl chain of 8 to 30, the number of fluorine atoms is from 0 to the maximum substitution of all the hydrogen atoms in the hydrophobic radical. Given a similar length of the oxyethylene chain and increased number of carbon atoms in the hydrophobic part of the molecule, and higher fluorination of nonionic SAAs, their solubility decreases. Where individual nonionic SAAs are mixed, the highest solubility is shown by mixtures containing compounds with the shortest and the longest oxyethylene chain.

The content of nonionic SAAs in the composition is 0.1-1% by weight, which is attributable to the low molecular solubility of the said nonionic SAAs in the composition. The reasons to use a lower SAA content to produce large-size soap bubbles are stated below.

Analyzing the philosophy of soap bubble blowing compositions, it should be noted that when soap bubbles are blown through a tube, the main difference between large-size soap bubble blowing and small-size soap bubble blowing is that the period in which a large bubble can be blown is much longer than that for a smaller one. For this reason, the film of a larger soap bubble is more prone to destruction due to evaporation of the solvent (film drying) and syneresis, which results in its premature burst. The film of a large soap bubble must not be thin, to achieve a longer lifetime of the bubble due to longer evaporation of the film. At the same time, the film must have a high viscosity to minimize syneresis effects, and must be elastic.

The specific feature of making a soap bubble with the soap bubble blowing device described in this application is the high speed of air flow out of the tube, and the ability to fly a bubble above the blower's head, thus making playing with, and watching soap bubbles easier. For the above reasons, special requirements are set for a soap bubble blowing composition.

The principle of the composition for blowing large-size soap bubbles is to obtain a compound where an anion-active SAA and a nonionic SAA over film-stabilizing components, high-molecular substances, and electrolytes make a solution of a rather low viscosity. During the bubble blowing, the viscosity of the composition drastically increases, since the composition is concentrated in the process of bubble blowing as the solvent evaporates. Furthermore, the initial concentration of SAAs and high-molecular substances must not be high, so that the soap bubble film contain as much water or other polar solvents as possible. Therefore, the quantity of SAA and other soluble components of the composition should not preferably exceed 5% by weight. At higher SAA contents, the film produced gets more faded or white, and its strength often drops. At contents of the composition's soluble components below 5% by weight, the lifetime of the bubble film greatly increases due to a thicker soap bubble film generated, and to a longer evaporation period of the solvent, the content of which increases in this case. Besides, to obtain a highly durable film of a large soap bubble, high intermolecular interaction and volume structuring of the composition is required. To achieve this, a nonionic SAA having a low true solubility and a high adsorption at the water-air boundary, and components stabilizing the soap bubble film are added to the composition.

The behavior of nonionic SAAs in aqueous solutions is determined by their intermolecular interaction. Their dissolution is subject to interaction of water and the oxygen atom of the oxyethylene group; hydration brings about associates, resulting in modification of the composition's properties and therefore in a stronger film of soap bubbles, as the adsorption layers contains, in addition to SAA molecules, also water molecules connected to oxygen atoms of the oxyethylene group. Given a fraction of low-solubility anion-active SAAs and nonionic SAAs in the composition, the soap bubble film gets stringer as the bubble is blown and the solvent evaporates. Since the solubility of the said nonionic SAAs by water and by many polar solvents is much lower than that of anion-active SAAs, joint dissolution of anion-active and nonionic SAAs results in a structured composition at their low contents, which is necessary to obtain a large soap bubble film. Association of nonionic SAA with water molecules leads to a higher viscosity of the composition, stronger soap bubble film, and its predominant adsorption at the phase boundary.

The ratio of anion-active SAAs and nonionic SAAs in the soap bubble blowing composition is generally between 1:3 and 1:30. These ratios provide for component contents that are optimal for producing a large soap bubble film that is durable and colorful. The soap bubble film becomes strong, transparent, and shining, and playing all rainbow colors in the light, as it is colored by light interference that takes place. This effect occurs at a certain film thickness, and depends on the components ratio.

The components used to stabilize the soap bubble film are long-chain linear and cross-linked molecules, among which are hydrophobic radicals found at the ends, and hydrophilic groups in the middle part of the molecule. In particular, such are substances formed by long-chain molecules with hydrophobic radicals, such as $R(CH_2CH_2O)_nOR$, $RAr(CH_2CH_2O)_n OArR$, $RO(CH_2CH_2O)_nOR$, $RAr(CH_2CH_2O)_n OR$, or similar. The number of carbon atoms in the hydrophobic chain R is generally 6 to 20, and the number of ethylene oxide groups n=1 to 30. Hydrophobic radicals may contain fluorine atoms instead of hydrogen atoms. Ethylene oxide groups may be substituted in such substances with other hydrophobic groups, such as propylene oxide etc. The film stabilization is hypothetically due to interaction between the hydrophobic radicals of the stabilizer molecule and the hydrophobic part of SAA, and interaction of the hydrophilic part of the stabilizer molecule with water molecules. Thus, a structured soap bubble film of improved strength is generated. Film-stabilizing components added to the composition enable to produce large soap bubbles of optimum thickness and color effect. The quantity of components strengthening the soap bubble film usually does not exceed 1% by weight.

The high-molecular substances used in the composition to improve the elasticity of the soap bubble film are known substances from the group of polyvinyl pyrrolidone, polyethylene glycol, and polyvinyl alcohol, and water-soluble derivatives of cellulose: hydroxyethyl cellulose, hydroxypropyl cellulose, carboxymethyl cellulose, etc. The content of such components is generally 0.1 to 1% for substances with a molecular weight of 1000-200000, and is related to specific properties of such substances. The content of high-molecular substances also should not be high, to avoid increasing the content of soluble components unreasonably, as their increase results in excessive viscosity of the composition and too fast drying and destruction of a large soap bubble's film.

The electrolytes used in the composition are various substances modifying the solubility of SAAs and other components of the composition due to the desalting effect, binding SAAs into complexes and structured solutions, or stabilizing the composition's pH, and also affecting the viscosity and surface tension of the soap bubble film. Used as such substances are salts, with anions represented by chlorides, sulfates, acetates, gluconates, etc., and with cations represented by ions of ammonium, sodium, potassium, calcium, magnesium, aluminum, etc. To control pH of the composition, salts and weak acids are used that may have bactericide properties. Such are in particular sodium benzoate and benzoic acid, sodium tetraborate and boric acid, sorbic acid, ethylene diamine tetraacetic acid, calcium and magnesium chlorides etc.

It should also be noted that the composition may be enhanced with substances upsetting structuring of water (for example, carbamide in amounts of up to 1% by weight promotes release of water molecules for hydration of the oxyethylene chain). Substances modifying the taste and color of the composition may also be used (citric acid, flavor additives, sweeteners such as fructose, glucose, saccharose, or xylite and sorbite (at contents of 0.1 to 10%) and food colorants) etc.

The solvents used for the soap bubble composition are water and other polar solvents. Typical for the aqueous soap bubble blowing composition is generation of colorful, elastic, and durable film, the water content being 99 to 95% by weight. The use of non-aqueous solvents having a boiling point above the water boiling point improves the color effect and stability of the soap bubble film. Where the composition contains non-aqueous solvents, some of the water is substituted with these. In such a composition, the content of non-aqueous solvents may be within a broad range reaching 90% by weight, which enables to produce a large soap bubble with a film virtually resistant to drying. Generally, food glycerin is used as non-aqueous solvent. Apart from glycerin, the composition may use other high-boiling polar water-soluble solvents: propylene glycol, polyglycols, etc.

The anion-active SAA content in the soap bubble blowing composition is generally below the critical concentration of micelle generation (CCM) typical for these SAAs. The nonionic SAA content may be lower than CCM, may be at the level of CCM, or above CCM. Micelle generation is typical for all types of SAA, but for nonionic SAAs, the CCM values are approximately two orders lower than for anion-active SAAs with a similar hydrocarbon chain. By using poorly soluble nonionic SAAs, CCM of the composition may be reduced. When anion-active and nonionic SAAs are both contained in the solution, mixed-chemistry micelles are generated, comprising molecules of nonionic and anion-active SAA, and components stabilizing the soap bubble film connected to water molecules, high-molecular substances, and electrolyte ions. In such composition, micelle generation is observed for a nonionic SAA content below 1% by weight or for an anion-active SAA content below 3% by weight.

To provide mixed micelle generation for a more complex composition, solubilizing properties of SAAs are used. CCM-based composition structure is used to solubilize organic substances that are insoluble or poorly soluble by water and polar solvents, i.e. hydrocarbons, long-chain alcanols, fluoroaliphatic compounds, etc. These compounds may affect the properties of the soap bubble film. When the quantity of solubilized organic substances added to the SAA solution is increased, the molecular weight of micelles grows due to the increasing number of SAA molecules in a micelle and to carbon pickup, which leads to micelle growth (buildup) by solubilized compounds. Oxyethylated substances such as long-chain components stabilizing the soap bubble film and having low solubility in the composition may be used as solubilized organic substances. Substances that slowly evaporate in the air may also be used, such as liquid wax hydrocarbons with the number of carbon atoms in the chain of C8 to C20, or more preferably, C10 to C16; alcohols (alcanols) with C6 to C22, or more preferably, C8-C16, as well as aromatic hydrocarbons, unsaturated hydrocarbons, fluorinated hydrocarbons and fluorinated alcohols, etc. That is, they are non-toxic organic and fluorine organic substances evaporating in the air slower than water evaporates, and solubilized by the composition. When a soap bubble is blown, solubilized substances enter the film; this improves the colorful appearance of the film, its strength, and promoted its longer drying in the air. The amount of solubilized organic substances, hydrocarbons, and fluorine-containing compounds generally does not exceed 5% by weight.

The low content of SAA and other components in the soap bubble blowing composition, and the high strength of the film results in a small quantity of film particles and droplets generating when the bubble bursts. When the ratio of the composition's components is optimal, the film of a burst soap bubble gathers into one or several large drops or clots. The number of the generating small drops and film particles is minimum, and, since the components are not toxic and are used in low contents, the composition does not irritate skin, eyes, and respiratory tracts, and may be used for bubble blowing in the direct vicinity of the blower's face.

As anion-active SAAs of the film-generating composition, substances may be used that are commercially produced and certified for manufacturing of children's shampoos and cosmetic products, such as SAA components and high-molecular compounds made by the Unger and Clariant groups.

Ufarol TCL 92—powder of linear sodium lauryl sulfate

Ufasan TEA—linear triethanolamine alkyl benzene sulfonate

Ungerol N 2-70 and Ungerol LES 3-70—sodium lauryl ethoxysulfates with two and three molecules of ethylene oxide (sodium laureth sulfate)

Tylose CBR 10000 G1 Carboxymethyl cellulose

Tylose H 10000 G4, H 200000 YP2—hydroxyethyl cellulose, etc.

DESCRIPTION OF EMBODIMENTS OF THE INVENTION

Example 1

To 100 ml of distilled water, add 3 g of linear sodium lauryl sulfate manufactured by Unger (Ufarol TCL 92), 0.1 g of oxyethylated alkyl phenol with the number of carbon atoms in the alkyl part of the hydrophobic chain being C14 to C20, and with the number of oxyethylated groups n=1, 0.1 g of carboxymethyl cellulose manufactured by Clariant (Tylose CBR 10000 G1), 0.5 g of sodium chloride, and 0.5 g of sodium benzoate. Dissolve the components heated to 50-60° C. and mixed for 1 hour. After cooling down, use the composition to blow soap bubbles 10-50 cm in diameter with a soap bubble blowing device.

Example 2

To 100 ml of distilled water, add 3 g of linear triethanolamine alkyl benzene sulfonate by Unger (Ufasan TEA), 1 g of oxyethylated alkyl phenol with the number of carbon atoms in the alkyl part of the hydrophobic chain being C8 to C14, and with the number of oxyethylated groups n=5, 0.3 g of carboxymethyl cellulose by Clariant (Tylose CBR 10000 G1), 0.3 g of sodium chloride, and 0.5 g of sodium sorbate. Dissolve the components heated to 50-60° C. and mixed for 1 hour. After cooling down, use the composition to blow soap bubbles 10-50 cm in diameter.

Example 3

To 100 ml of distilled water, add 3 g of sodium laureth sulfate manufactured by Unger (Ungerol N 2-70), 0.3 g of oxyethylated alcanol with the number of carbon atoms in the alkyl part of the hydrophobic chain being C10 to C14, and with the number of oxyethylated groups n=2, 0.2 g of hydroxyethyl cellulose by Clariant (Tylose H 10000 G4), 0.1 g of calcium chloride, and 0.5 g of sodium benzoate. Dissolve the components heated to 50-60° C. and mixed for 1 hour. After cooling down, use the composition to blow soap bubbles 10-50 cm in diameter.

Example 4

To 100 ml of distilled water, add 3 g of sodium laureth sulfate by Unger (Ungerol LES 3-70), 0.5 g of oxyethylated alcanol with the number of carbon atoms in the alkyl part of the hydrophobic chain being C8 to C20, and with the number of oxyethylated groups n=3, 0.2 g of hydroxyethyl cellulose by Clariant (Tylose H 10000 G4), 0.2 g of magnesium chloride, and 0.1 g of a mixture of components $R(CH_2CH_2O)_nOR$, $RAr(CH_2CH_2O)_nOR$, and $RAr(CH_2CH_2O)_nOArR$, where R contains 6 to 20 carbon atoms, and n=1 to 12. Dissolve the components heated to 50-60° C. and mixed for 1 hour. After cooling down, use the composition to blow soap bubbles 10-60 cm in diameter.

Example 5

To 100 ml of distilled water, add 3 g of sodium laureth sulfate by Unger (Ungerol LES 3-70), 0.5 g of oxyethylated alcanol with the number of carbon atoms in the alkyl part of the hydrophobic chain being C10 to C14, and with the number of oxyethylated groups n=3, 0.2 g of hydroxyethyl cellulose by Clariant (Tylose H 10000 G4), 0.1 g of calcium chloride, and 1 g of wax hydrocarbons with C10 to C16. Dissolve the components heated to 50-60° C. and mixed for 1 hour. After cooling down, use the composition to blow soap bubbles 10-50 cm in diameter.

Example 6

To 100 ml of distilled water, add 3 g of sodium laureth sulfate by Unger (Ungerol LES 3-70), 0.5 g of oxyethylated fluorine-containing alcanol with the number of carbon atoms in the alkyl part of the hydrophobic chain being C8 to C10, and with the number of oxyethylated groups n=4, 0.5 g of hydroxyethyl cellulose by Clariant (Tylose H 10000 G4), 0.1 g of calcium chloride, and 0.5 g of sodium benzoate. Dissolve the components heated to 50-60° C. and mixed for 1 hour. After cooling down, use the composition to blow soap bubbles 10-60 cm in diameter.

Example 7

To 100 ml of distilled water, add 3 g of sodium laureth sulfate by Unger (Ungerol LES 3-70), 0.5 g of oxyethylated fluorine-containing alcanol with the number of carbon atoms in the alkyl part of the hydrophobic chain being C8 to C10, and with the number of oxyethylated groups n=4, 0.5 g of hydroxyethyl cellulose by Clariant (Tylose H 10000 G4), 0.1 g of calcium chloride, and 0.1 g of a mixture of components $R(CH_2CH_2O)_nOR$, $RAr(CH_2CH_2O)_nOR$, and $RAr(CH_2CH_2O)_nOArR$, where R is a hydrophobic fluorine-containing radical, in which the hydrogen atoms are substituted with fluorine atoms, and comprising 6 to 16 carbon atoms in a linear or cross-linked alkyl chain, and n=8 to 30. Dissolve the components heated to 50-60° C. and mixed for 1 hour. After cooling down, use the composition to blow soap bubbles 10-70 cm in diameter.

Example 8

To 100 ml of distilled water and 50 g of glycerin, add 3 g of sodium laureth sulfate by Unger (Ungerol N 2-70), 0.5 g of oxyethylated alcanol with the number of carbon atoms in the alkyl part of the hydrophobic chain being C10 to C14 and with the number of oxyethylated groups n=2, 0.2 g of hydroxyethyl cellulose by Clariant (Tylose H 10000 G4), 0.1 g of calcium chloride, and 0.5 g of sodium benzoate. Dissolve the components heated to 50-60° C. and mixed for 1 hour. After cooling down, use the composition to blow soap bubbles 10-80 cm in diameter.

Example 9

To a mixture of 10 ml of distilled water and 90 g of glycerin, add 4 g of sodium laureth sulfate by Unger (Ungerol LES 3-70), 0.5 g of oxyethylated alcanol with the number of carbon atoms in the alkyl part of the hydrophobic chain being C10 to C14 and with the number of oxyethylated groups n=3, 0.5 g of polyvinyl pyrrolidone, 0.1 g of calcium chloride, 0.5 g of alcanols with C8-C16, and 0.5 g of carbamide. Dissolve the components heated to 50-60° C. and mixed for 1 hour. After cooling down, use the composition to blow soap bubbles 10-100 cm in diameter.

Soap bubbles containing glycerin have a more durable film, they can soar in the air for a long time without bursting, and offer a more colorful play of all rainbow colors in the light. Such bubbles can be kept in the air for several minutes, creating upward air flows with a fan or otherwise, while the bubbles change their shape, break into smaller bubbles, or merge into larger bubbles when colliding.

The above composition versions are intended for use with a soap bubble blowing device as per this application, but may also be used with other devices used to obtain soap bubbles of larger sizes.

I claim:

1. A soap bubble blowing device, comprising a tube having one end from which air is supplied and another end at which air bubbles are generated, said tube having apertures for air inflow, said tube having a wall with an outer surface provided with folds which form the outer surface including alternating protrusions and recesses; and further comprising a lid with a built-in nipple and a container for a composition, said tube being inserted into said lid with a gap between a wall of said lid and said tube.

2. A soap bubble blowing device as defined in claim 1, wherein said another end at which the soap bubbles are generated is provided with a ledge formed as a bulge of said tube.

3. A soap bubble blowing device as defined in claim 2, wherein said ledge has a rear part provided with indents.

4. A soap bubble blowing device as defined in claim 1; and further comprising a built-in nipple which is fixed on said tube, said nipple being rotatable about an axis of said tube.

5. A soap bubble blowing device as defined in claim 4; and further comprising flexible connecting strips which fix said built-in nipple on said tube.

6. A soap bubble blowing device as defined in claim 1, wherein said tube has an axis and is rotatable about said axis.

7. A soap bubble blowing device as defined in claim 1, wherein said tube is composed of a deformable material so as to allow adjustments of dimensions, a shape, and a flow area of said apertures.

8. A soap bubble blowing device as defined in claim 1, wherein said apertures are configured as slots arranged between said protrusions and said recesses on a surface of said tube.

9. A soap bubble blowing device as defined in claim 1, wherein said folds of said tube are provided with additional slots for wetting a surface of said tube with water.

10. A soap bubble blowing device as defined in claim 1; and further comprising a water-wetted porous material which covers said apertures for higher damping efficiency.

11. A soap bubble blowing device as defined in claim 1; and further comprising a casing with a heater for air supplied for generation of soap bubbles, said tube being inserted in said casing.

12. A soap bubble blowing device as defined in claim 1, wherein said gap is formed by said recesses.

13. A soap bubble blowing device as defined in claim 1, wherein said tube is insertable into said lid with deformation of said folds of said tube.

14. A soap bubble blowing device as defined in claim 13, wherein said tube is displaceable along said lid thus changing a flow area of an end outlet of said tube.

* * * * *